US008006430B2

(12) United States Patent
Wang

(10) Patent No.: US 8,006,430 B2
(45) Date of Patent: Aug. 30, 2011

(54) UNIVERSAL SCOPE MOUNT FOR FIREARM

(75) Inventor: Min-hung Wang, Tantz Shiang (TW)

(73) Assignee: Asia Optical Co., Inc., Tantz Shiang, Taichung (TW)

( * ) Notice: Subject to any disclaimer, the term of this patent is extended or adjusted under 35 U.S.C. 154(b) by 108 days.

(21) Appl. No.: 12/560,163

(22) Filed: Sep. 15, 2009

(65) Prior Publication Data

US 2011/0061286 A1 Mar. 17, 2011

(51) Int. Cl.
*F41G 1/387* (2006.01)

(52) U.S. Cl. ..... 42/125; 42/129

(58) Field of Classification Search ..... 42/85, 124, 42/125, 126, 127, 129
See application file for complete search history.

(56) References Cited

U.S. PATENT DOCUMENTS

| | | | | | |
|---|---|---|---|---|---|
| 2,202,000 | A * | 5/1940 | Gray | 42/124 |
| 2,632,253 | A * | 3/1953 | Stith | 42/126 |
| 2,911,723 | A * | 11/1959 | Ashbrook | 42/126 |
| 3,374,544 | A * | 3/1968 | Pitchford | 42/126 |
| 3,401,460 | A * | 9/1968 | Tellie | 42/124 |
| 3,734,437 | A * | 5/1973 | Underwood | 248/205.1 |
| 4,121,363 | A * | 10/1978 | York | 42/127 |
| 4,959,908 | A * | 10/1990 | Weyrauch | 42/124 |
| 5,086,566 | A * | 2/1992 | Klumpp | 42/126 |
| 5,533,267 | A * | 7/1996 | Haight, Jr. | 42/124 |
| 6,705,037 | B2 * | 3/2004 | Van Kirk | 42/126 |
| 7,140,143 | B1 * | 11/2006 | Ivey | 42/125 |
| 7,543,405 | B1 * | 6/2009 | Ivey | 42/125 |
| 7,739,822 | B1 * | 6/2010 | Holmberg | 42/90 |
| 7,891,131 | B2 * | 2/2011 | Holmberg | 42/124 |
| 2003/0192224 | A1 * | 10/2003 | Kirk | 42/124 |
| 2009/0288328 | A1 * | 11/2009 | Kiser | 42/124 |
| 2009/0307956 | A1 * | 12/2009 | Barret | 42/125 |

* cited by examiner

*Primary Examiner* — Benjamin P Lee
(74) *Attorney, Agent, or Firm* — Cheng-Ju Chiang

(57) ABSTRACT

A universal scope mount includes a housing and a pair of mounting assemblies. The housing has a chamber defined through front and rear ends thereof and having an inner contour conforming to an outer contour of a body of a scope or an accessory to be received therein, a channel downwardly exposed and extending parallel to the chamber and a pair of projections formed along respective opposite sides of the channel. The pair of mounting assemblies is used to respectively secure a front end portion and a rear end portion of the housing to the mount base of the firearm. Each mounting assembly includes a slider to be slidably received in the channel of the housing and supported by the projections of the housing, a mount member to be disposed between the housing and the mount base of the firearm, securing means to securely connect the mount member to the upper attachment surface of the mount base of the firearm, and fastening means to reliably assemble the housing, the slider and the mount member together. The slider has a cross-sectional contour substantially complementary to a cross-sectional contour of the channel of the housing. The mount member has an upper mating surface defining two grooves to receive corresponding projections of the housing therein and a bottom opening having a cross-sectional contour substantially complementary to a cross-sectional contour of the mount base of the firearm.

19 Claims, 9 Drawing Sheets

UNIVERSAL SCOPE MOUNT FOR FIREARM

BACKGROUND OF THE INVENTION

1. Field of the Invention

The present invention relates to a scope mount for firearms, and particularly to a universal scope mount that can attach a variety of different scopes or other accessories to a firearm such as a rifle, without the need to purchase multiple scope mounts.

2. Description of Prior Art

Firearms such as rifles have long included scopes for accurate aiming of the rifle at a target. Various different scopes have been developed which have different purposes and different sizes. These scopes are generally attached to the rifle in a readily detachable and replaceable manner, such that various different scopes can be interchangeably connected to the rifle depending on the needs of the user. To facilitate the secure and precise attachment of different scopes, rifles have been commonly configured to include a mount base at the top of the rifle which has become a standard for attachment of many different types of rifle scopes. A scope mount is subsequently attached to the mount base for mounting a scope on the rifle.

As shown in FIGS. 1-4, in a typical conventional scope mounting arrangement, there provided two identical scope rings 8 which are spaced apart along the length of a rifle 7 thereby providing a two point mounting for a scope 9. Each scope ring 8 includes a mount member 80 to be attached to a mount base 70 on the rifle 7 (shown in FIG. 4) and a clamp member 81 to be attached to the mount member 80. The mount member 80 has a base-engaging portion 82 defining a lengthwise channel 83 at the bottom thereof and a receptacle portion 84 integrally formed at the top of the base-engaging portion 82. The lengthwise channel 83 has a general dovetail shape as viewed in FIGS. 1 and 2 which conforms with an upper engaging portion 78 of the mount base 70. A lengthwise bore 85 is further defined in the base-engaging portion 82 in communication with the lengthwise channel 83 for extension of a bolt 52 therethrough. The receptacle portion 84 defines a semicircular receptacle 840 which receives a body 90 of the scope 9. The semicircular receptacle 840 terminates in two outwardly projecting flanges 841 with one or more screw holes 842 vertically defined therethrough for reception of screws 51. The clamp member 81, which has a configuration similar to the receptacle portion 84 of the mount member 80, also includes a semicircular receptacle 810, two outwardly projecting flanges 811 and one or more screw holes 812 in each flange 811.

When attaching the scope 9 to the rifle 7, the mount member 80 of each scope ring 8 is first attached to the mount base 70 on the rifle 7 with the lengthwise channel 83 thereof receiving the complementary upper engaging portion 78 of the mount base 70 therein and with the lengthwise bore 85 thereof aligned with a corresponding groove 76 in the mount base 70. A bolt 52 is then extended through the lengthwise bore 85 and the groove 76 in the mount base 70 with a free end thereof outwardly exposed for securing with a nut 53, thereby securely attaching the mount member 80 to the mount base 70. The scope body 90 is then positioned in the receptacle portions 84 of the front and rear mount members 80. Once the scope 9 is in the desired position, the two clamp members 81 are placed over the body 90 of the scope 9 directly above the respective mount members 80 so that flanges 811 of each clamp member 81 align with flanges 841 of the corresponding mount member 80. The clamp members 81 and the mount members 80 are then attached together with screws 51, thereby forming a scope ring 8 to clamp the scope 9 in place.

A significant problem with the above conventional scope rings 8 is that these scope rings 8 cannot be universally fit onto scope bodies 90 having different outer diameters. In order to achieve the secure attachment and thus aiming accuracy necessary for a scope 9, a scope ring 8 having an inner ring diameter substantially equal to an outer diameter of the scope body 90 must be required.

This brings inconveniences to users that prefer to use several different scopes 9 on a single rifle 7. In order for them to change scopes 9 having different body diameters, they would have to purchase new scope rings 8 to substitute the whole original scope ring 8 on the rifle 7. This is uneconomical and takes time, besides the need for the user to purchase a separate scope ring 8 for each individual scope 9. Further, the above conventional scope ring 8 is also limited in its applications in that it is inapplicable to scopes 9 having complex or irregular body contours. When the body 90 of a scope 9 is not cylindrical in shape or has an irregular contour, the above conventional scope ring 8 is no longer applicable to such a scope 9. In addition, the above conventional scope ring 8 is complex in configuration, which is difficult to manufacture and thus increases cost.

Hence, an improved scope mount is desired to address the aforesaid shortcomings of conventional scope rings.

SUMMARY OF THE INVENTION

Accordingly, one object of the present invention is to provide a universal scope mount that allows the user to mount a large variety of different scopes or other accessories to a single firearm without the need to purchase multiple scope mounts.

Another object of the present invention is to provide a universal scope mount that is especially applicable to scopes having complex or irregular body contours.

A further object of the present invention is to provide a universal scope mount that is uncomplicated in configuration and easy to manufacture.

To achieve the above objects, the present invention provides a universal scope mount for a firearm having a mount base affixed thereon for mounting scopes and other accessories thereto. The mount base of the firearm has an upper attachment surface to which the scopes and other accessories can be connected. The present universal scope mount includes a housing and a pair of mounting assemblies. The housing has a chamber defined through front and rear ends thereof, a channel downwardly exposed and extending parallel to the chamber and a pair of projections formed along respective opposite sides of the channel. The chamber has an inner contour conforming to an outer contour of a body of a scope or an accessory to be received therein. The pair of mounting assemblies is used to respectively secure a front end portion and a rear end portion of the housing to the mount base of the firearm. Each mounting assembly includes a slider to be slidably received in the channel of the housing and supported by the projections of the housing, a mount member to be disposed between the housing and the mount base of the firearm, securing means to securely connect the mount member to the upper attachment surface of the mount base of the firearm, and fastening means to reliably assemble the housing, the slider and the mount member together. The slider has a cross-sectional contour substantially complementary to a cross-sectional contour of the channel of the housing. The mount member has an upper mating surface defining two grooves to receive corresponding projections of the housing therein and a bottom opening having a cross-sectional contour substantially complementary to a cross-sectional contour of the mount base of the firearm.

According to a preferred embodiment of the present invention, the channel of the housing has a substantial T-shape in cross section and is comprised of an upper horizontal portion and a lower vertical portion, and the slider is received in the upper horizontal portion of the channel. The upper horizontal portion of the channel has opposed side slopes at a lower end thereof proximate to the lower vertical portion, and the slider has opposite side slopes to abut against corresponding side slopes of the channel. The side slopes of both the channel and the slider slant toward each other at an approximately 45-degree angle.

According to a preferred embodiment of the present invention, each projection of the housing has opposite side bevels at a free end thereof, and each groove of the mount member has opposite side slants to abut against the side bevels of a corresponding projection of the housing.

According to a preferred embodiment of the present invention, the mount member defines two through holes through the upper mating surface, and the slider defines two screw holes spaced at a distance substantially equal to that between the two through holes of the mount member. The two through holes of the mount member are defined through a mount tooth formed between the two grooves. The fastening means includes two screws to be respectively screwed into the two through holes of the mount member and the two screw holes of the slider.

According to a preferred embodiment of the present invention, the bottom opening of the mount member includes a roof having a width substantially equal to a width of the upper attachment surface of the mount base of the firearm.

According to a preferred embodiment of the present invention, the securing means includes a clamp member having an inner surface at least partially facing the cross-sectional contour of the bottom opening of the mount member, and an adjusting means to adjust the location of the clamp member toward and away from the cross-sectional contour of the bottom opening of the mount member, such that the clamp member can be caused to securely capture the mount base of the rifle between the clamp member and the cross-sectional contour of the bottom opening of the mount member. Preferably, the adjusting means includes a bolt to be extended through the mount member and the clamp member and a nut provided adjacent to the clamp member to be treaded onto a free end of the bolt.

According to a preferred embodiment of the present invention, the mount member has a side wall, a clamp side opposite to the side wall for connection with the clamp member and a bore defined therethrough in a direction perpendicular to the grooves for receiving the bolt, the bore including a base end in the side wall and a clamp end extending through the clamp side in communication with the bottom opening, and the clamp member defines a hole therethrough to align with the bore of the mount member and thus receive the free end of the bolt. The clamp end of the bore of the mount member is semi-circular in cross section to cooperate with a corresponding transverse groove in the upper attachment surface of the mount base of the firearm to form a circular hole for extension of the bolt.

According to a preferred embodiment of the present invention, the mount member has a side wall and a clamp side opposite to the side wall for connection with the clamp member, and the bottom opening of the mount member includes a notch defined in the side wall to complementally receive a side rib of the mount base of the firearm. The inner surface of the clamp member has a height greater than a height of the clamp side of the mount member.

According to a preferred embodiment of the present invention, the clamp member has upper and lower flanges extending from respective opposite ends thereof in a common direction toward the mount member, the lower flange having an inner slanted surface extending at an angle matching that of a lower slope of a side rib of the mount base of the firearm opposite to the side rib received in the notch of the mount member. The mount member further comprises an upper bevel oriented between one groove and the clamp side, and the upper flange of the clamp member has an inner slanted surface extending at an angle matching that of the upper bevel of the mount member.

The universal scope mount constructed according to the present invention increases the mount versatility to a wider variety of applications. The housing of the present universal scope mount is configured to define a chamber having an inner contour conforming to an outer contour of the body of a scope to be received. Accordingly, the present universal scope mount is applicable to various scopes including those having complex or irregular body contours. In addition, the present universal scope mount is relatively simple in configuration, which facilitates manufacture and thus reduces cost. The present universal scope mount is preferably made of a lightweight material such as extruded aluminum, whereby manufacture is further facilitated and both the cost and weight of the present universal scope mount are reduced.

BRIEF DESCRIPTION OF THE DRAWINGS

The present invention may be best understood through the following description with reference to the accompanying drawings, in which.

DETAILED DESCRIPTION OF THE PREFERRED EMBODIMENTS

In the following detailed description of the preferred embodiments, reference is made to the accompanying drawings that form a part hereof, and the description is given by way of illustration of specific embodiments that the present invention may be practiced. In this regard, directional terminology, such as "top", "bottom", "front", "rear", "upper", "lower", "inner", and "outer" and the likes, is used with reference to the orientation of the figures being described.

Because components of the embodiments of the present invention can be positioned in a number of different orientations, the directional terminology is used for purposes of illustration and is in no way limiting.

Figure 10:
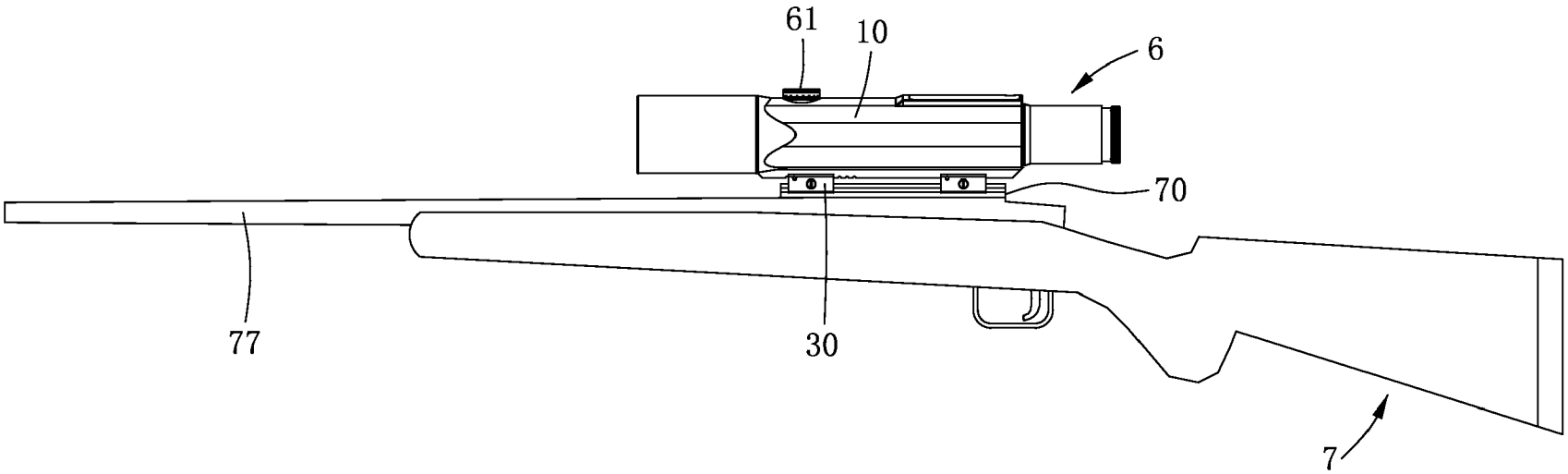
FIG. 10 is a side planar view showing a scope to be mounted on a rifle by engagement of the present universal scope mount with the mount base on the rifle.

As illustrated in FIG. 10, a universal scope mount 1 provided in the present invention is used to couple with a mount base 70 affixed to the top of a rifle 7, so as to attach a scope 6 to the rifle 7. The mount base 70 is a standard component readily available in the market and is schematically shown in the drawings for simplicity. The illustrated scope 6 represents one example of a number of existing scopes already in the market, and a preferred embodiment of the present invention as described below is disclosed for use with these existing scopes and other similar devices.

Figure 1:
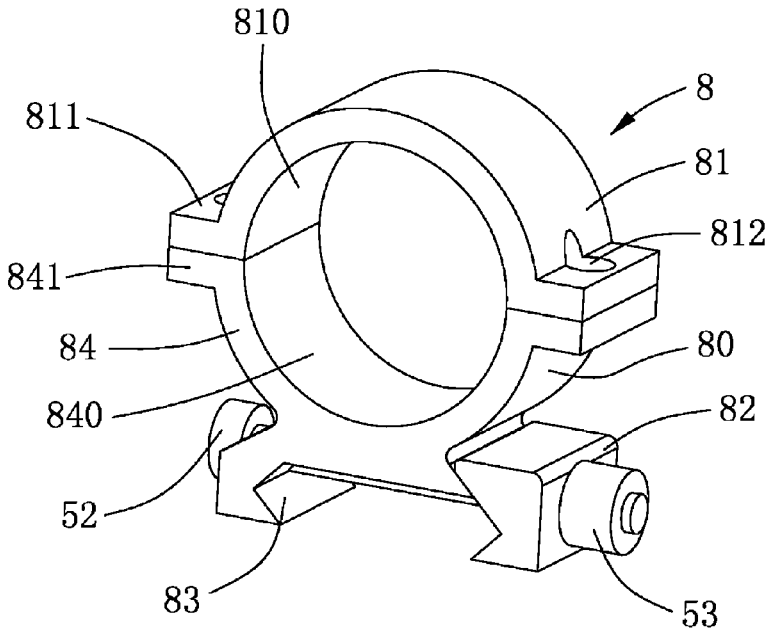
FIG. 1 (PRIOR ART)
FIG. 1 is a perspective view of a conventional scope ring.
Figure 2:
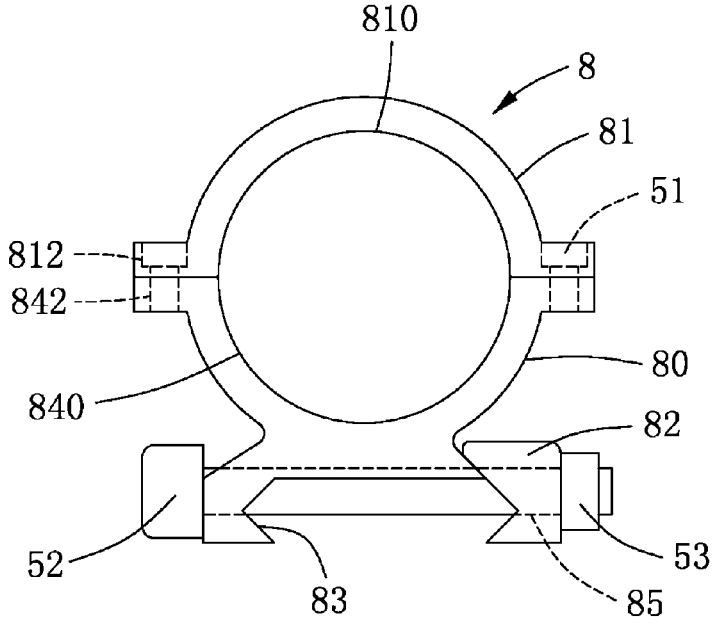
FIG. 2 (PRIOR ART)
FIG. 2 is a planar view of the conventional scope ring.
Figure 3:
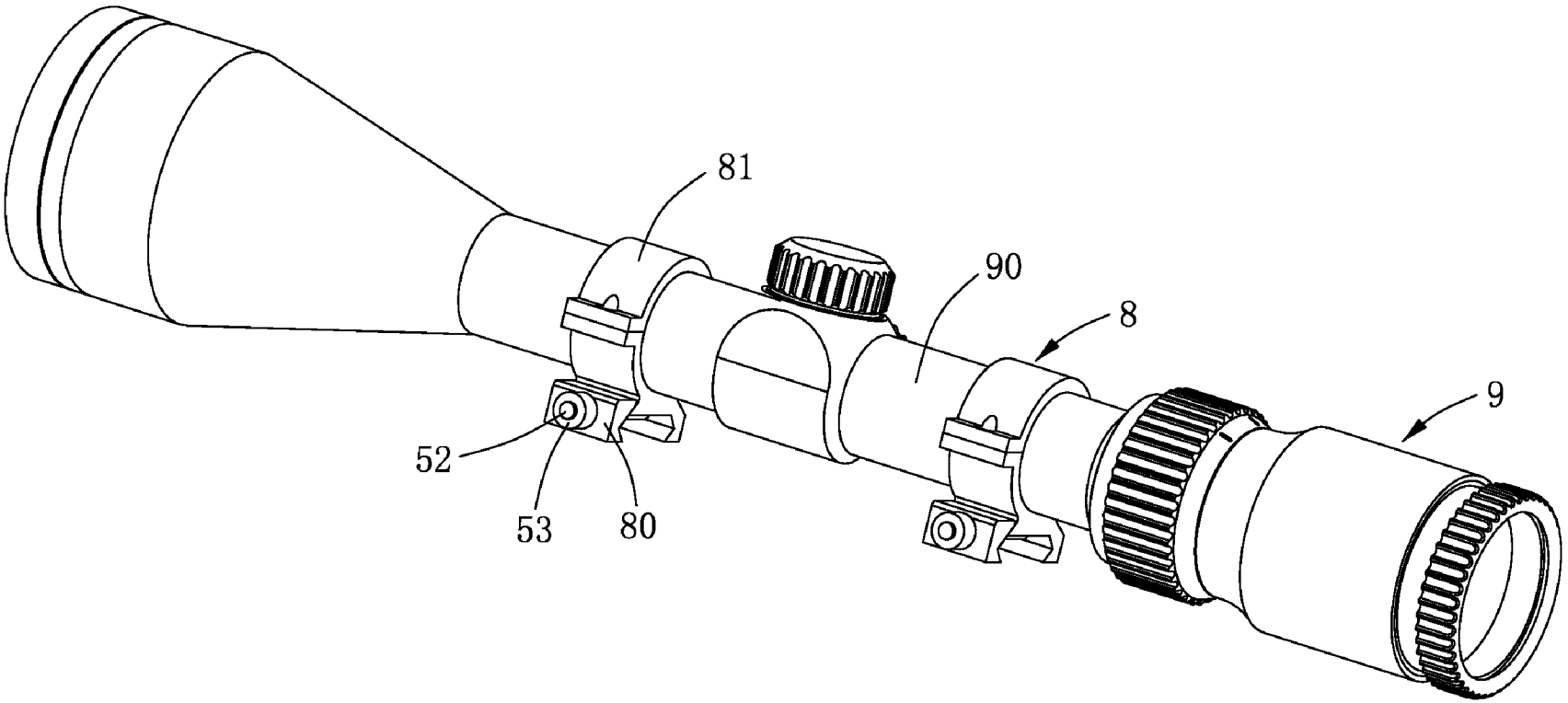
FIG. 3 (PRIOR ART)
FIG. 3 is a perspective view illustrating two conventional scope rings of FIG. 1 attached to a scope.
Figure 4:
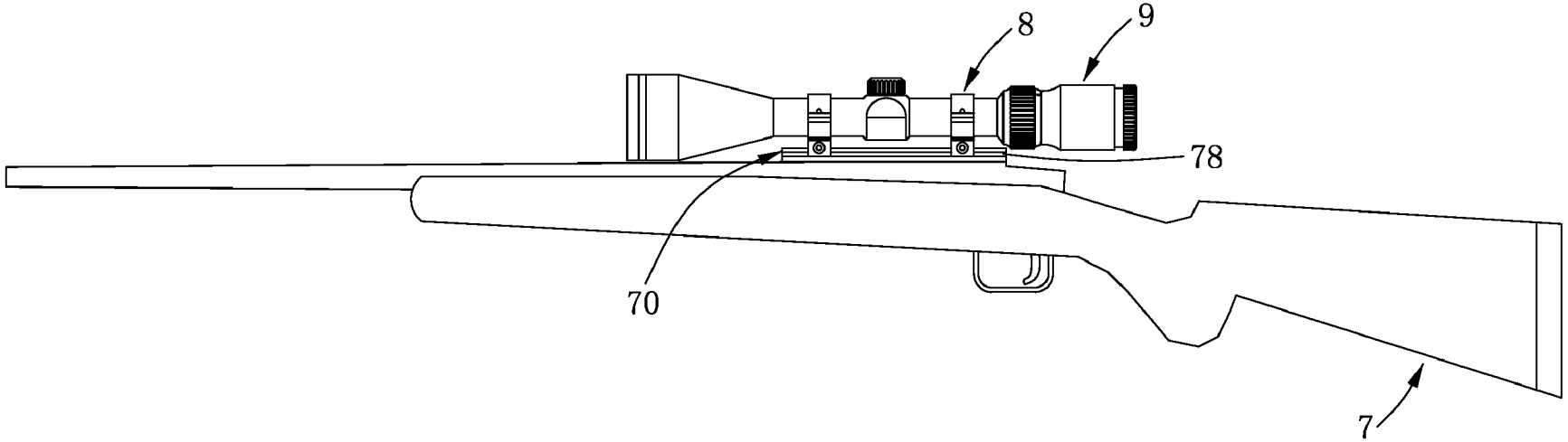
FIG. 4 (PRIOR ART)
FIG. 4 is a side planar view showing the scope to be mounted on a rifle by engagement of the conventional scope rings with a mount base on the rifle.
Figure 5:
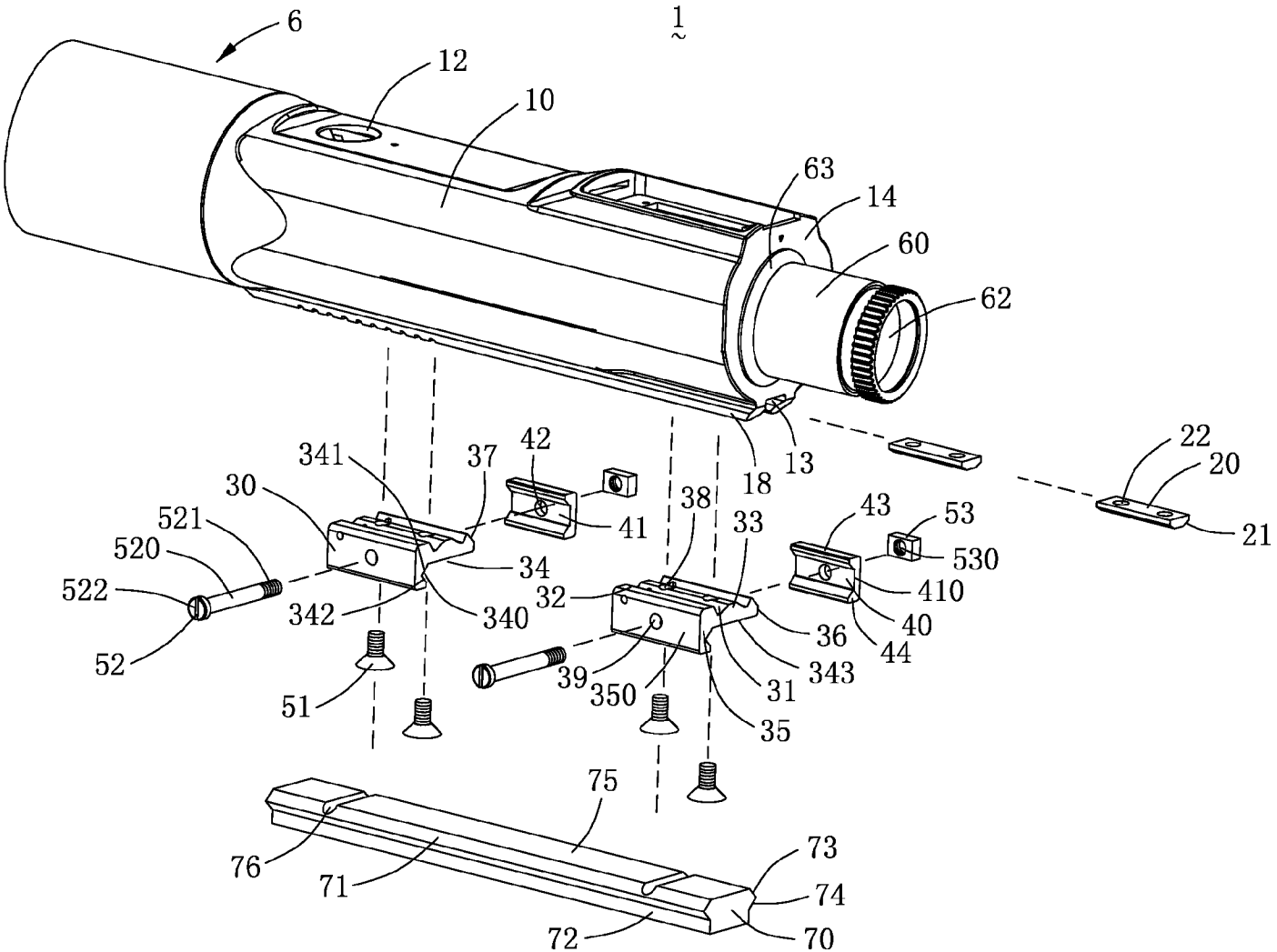
FIG. 5 is an exploded, perspective view of a universal scope mount of the present invention, with a scope and a mount base of a rifle also included.
Figure 6:
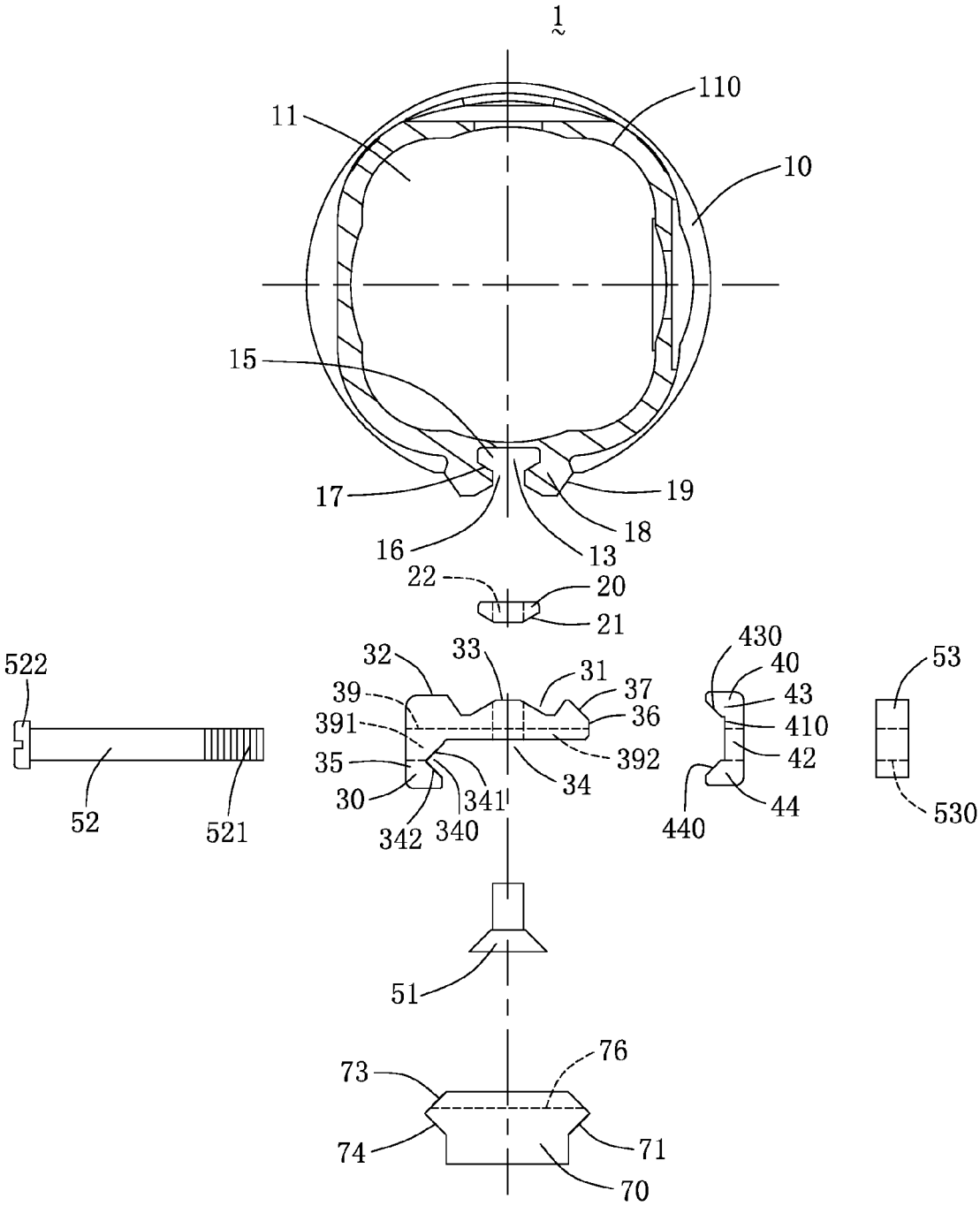
FIG. 6 is an exploded, end planar view of the present universal scope mount, with a housing thereof cross-sectioned and with the mount base of the rifle also included.

Reference in now made to FIGS. 5 and 6, which show exploded views of the universal scope mount 1 in accordance with a preferred embodiment of the present invention. The universal scope mount 1 generally comprises a housing 10 for receiving a scope 6 therein and two identical mounting assemblies, one set to secure a front end portion of the scope 6 to the rifle 7 and the other to secure a rear end portion of the scope 6. Hence, only one mounting assembly will be described in detail hereinafter. Both the front and the rear mounting assemblies are comprised of four main elements: a slider 20, a mount member 30 to connect the housing 10 to a mount base 70 provided at the top of the rifle 7, securing means to securely connect the mount member 30 to an upper attachment surface 75 of the mount base 70, and fastening means to reliably assemble the housing 10, the slider 20 and the mount member 30 together. According to a preferred embodiment of the present invention, the securing means consists of a clamp member 40, a bolt 52 and a nut 53, and the fastening means consists of two screws 51.

Figure 8:
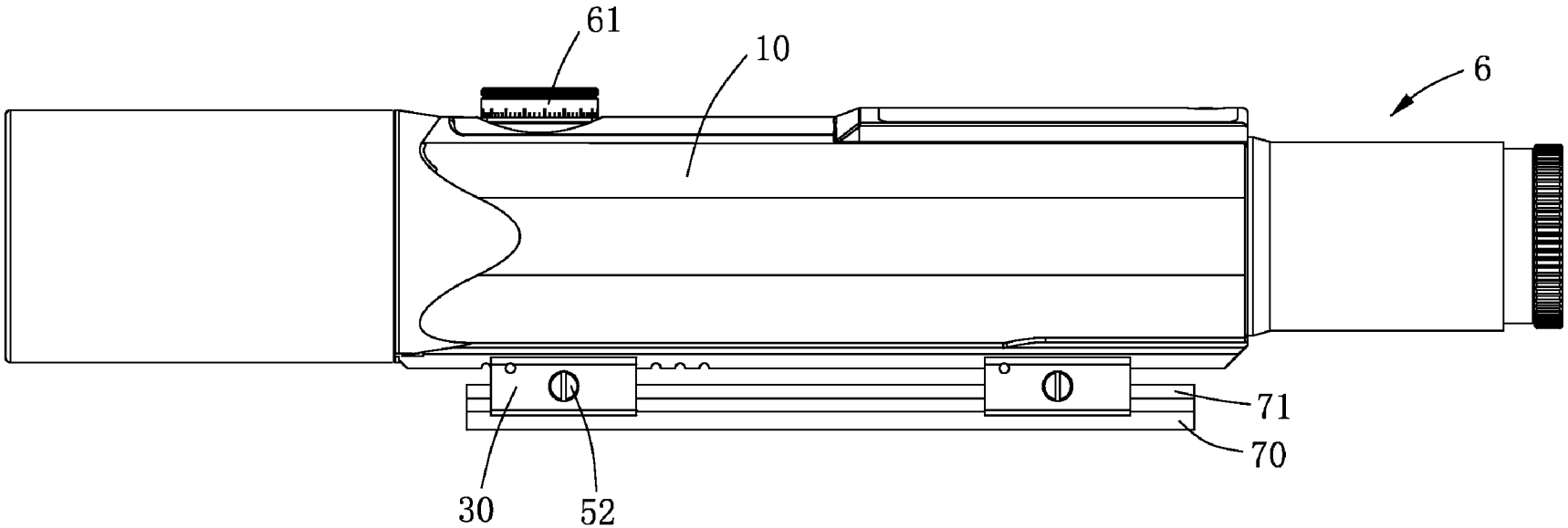
FIG. 8 is a side planar view illustrating the present universal scope mount attached to a scope and engaged with the mount base of the rifle.
Figure 9:
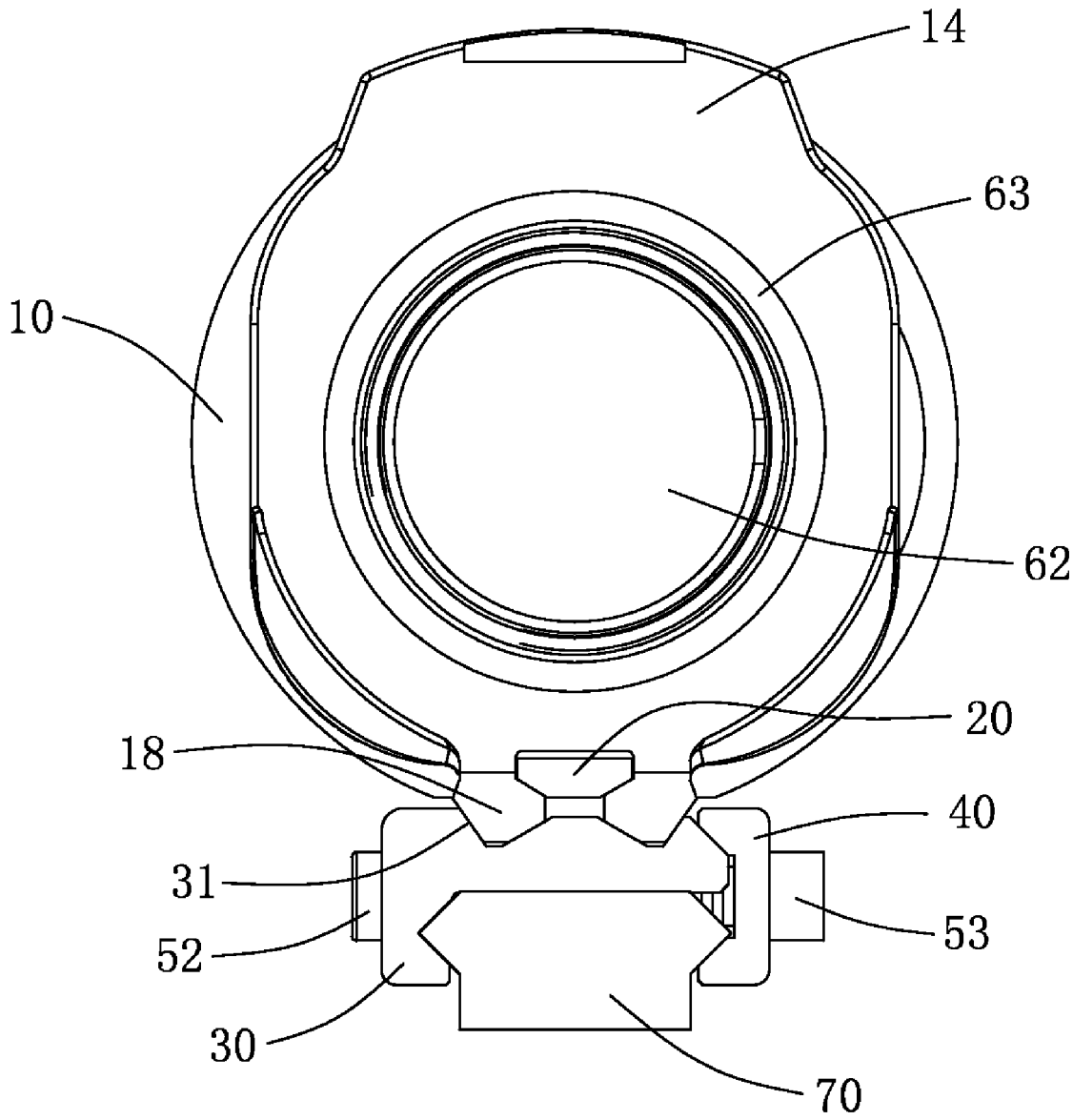
FIG. 9 is an end planar view of FIG. 8.

The housing 10 generally has a cylindrical outer contour and defines a chamber 11 through opposite ends thereof, an opening 12 in the top and a channel 13 in the bottom. The chamber 11 has an inner contour 110 conforming to an outer contour of a body 60 of the scope 6 for accommodating the scope body 60 therein. After proper positioning of the scope body 60 within the chamber 11 of the housing 10, an elevation knob 61 (shown in FIG. 8) provided at the top of the scope body 60 is upwardly exposed through the opening 12 for ease of manual operation, and a rear end surface 14 of the housing 10 proximate to an ocular lens 62 of the scope 6 abuts against a magnification ring 63 of the scope 6, which is also shown in FIG. 9. The channel 13 is defined in a lower surface of the housing 10 running the length of the housing 10 for receiving the slider 20 therein. The channel 13 is downwardly exposed and has a substantial T-shape in cross section. The channel 13 is comprised of an upper horizontal portion 15 and a lower vertical portion 16. The upper horizontal portion 15 has two opposed side slopes 17 at a lower end thereof proximate to the lower vertical portion 16. The two side slopes 17 slant toward each other at an approximately 45-degree angle. Provided on opposite sides of the channel 13 are two respective projections 18 each having opposite side bevels 19 at a free end thereof. The bevels 19 also extend toward each other at a selected angle.

The slider 20 has an outer contour conforming to an inner contour of the upper horizontal portion 15 of the channel 13, so as to be slidably received in the channel 13 of the housing 10. Correspondingly, the slider 20 also has opposite side slopes 21 at an approximately 45-degree angle toward a lower end thereof. Two screw holes 22 are defined through the slider 20 for extension of two respective screws 51.

The mount member 30 substantially having a rotated L-shape is disposed between the housing 10 and the mount base 70, and serves as a connecting element for connecting the latter two with each other. Therefore, the mount member 30 has a configuration substantially complementary to mating ends of the housing 10 and the mount base 70. Specifically, two grooves 31 are defined in an upper mating surface 32 of the mount member 30 along the length of the mount member 30. Each groove 31 has opposite sides slanted corresponding to the side bevels 19 of the projection 18 of the housing 10 for receiving the projection 18 therein. A mount tooth 33 is formed between the two grooves 31 to engage with an interspace between the two projections 18 of the housing 10. The mount tooth 33 is trapezoidal in cross section. The mount member 30 further has a bottom opening 34 extending parallel to the grooves 31. The bottom opening 34 has a notch 340 formed in a side wall 35 of the mount member 30 which extends perpendicularly from the upper mating surface 32. The notch 340 includes an upper slope 341 and a lower slope 342. The notch 340 is sized to receive one of side ribs 71 formed on the sides 72 of the mount base 70 therein, such that the upper slope 341 is adjacent an upper slope 73 of the side rib 71 of the mount base 70 and the lower slope 342 is adjacent a lower slope 74 of the side rib 71 of the mount base 70. As clearly shown in FIG. 7, the notch 340 is positioned such that when the side rib 71 of the mount base 70 is received in the notch 340, the upper attachment surface 75 of the mount base 70 is substantially parallel to and abut against a roof 343 of the bottom opening 34. The roof 343 has a width substantially equal to a width of the upper attachment surface 75 of the mount base 70, such that a clamp side 36 of the mount member 30 opposite to the side wall 35 is positioned adjacent the upper slope 73 of one of the side ribs 71 opposite the side rib 71 oriented within the notch 340, when the mount member 30 is overlying the upper attachment surface 75 of the mount base 70. Hence, the mount member 30 is provided with a bottom contour complementary to the upper attachment surface 75 of the mount base 70, providing the mount member 30 with a means to be securely connected to the upper attachment surface 75 of the mount base 70 when the clamp member 40 is utilized as described below. An upper bevel 37 is oriented between one groove 31 and the clamp side 36. The upper bevel 37 is preferably angled within a plane which diverges from a plane including the upper mating surface 32 by an angle of approximately 45 degree. The clamp side 36 extends down from the upper bevel 37 to the roof 343. The mount member 30 further defines two through holes 38 through the mount tooth 33. The two through holes 38 are spaced at a distance substantially equal to that between the two screw holes 22 of the slider 20, so that the through holes 38 can be aligned with corresponding screw holes 22 of the slider 20 for extension of the screws 51 therethrough. A bore 39 is further provided passing through the mount member 30 in a direction substantially perpendicular to the side wall 35 and the grooves 31. The two through holes 38 are located at respective opposite sides of the bore 39. As clearly shown in FIG. 6, the bore 39 includes a base end 391 in the side wall 35 and a clamp end 392 extending through the clamp side 36. The clamp end 392 is preferably semi-circular and is located at a lower end of the clamp side 36.

The clamp member 40 is provided for connection of the mount member 30 to the mount base 70. The clamp member 40 includes a body 41 defining a hole 42 therethrough corresponding to the bore 39 in the mount member 30, and upper and lower flanges 43, 44 perpendicularly extending from respective opposite ends of the body 41 in a common direction. Each of the upper and lower flanges 43, 44 has an inner slanted surface 430, 440 extending away from an inner surface 410 of the body 41 at an angle of approximately 45 degree which matches the angle of the upper bevel 37 of the mount member 30. Preferably, an inner surface 410 of the body 41 has a height greater than a height of the clamp side 36 of the mount member 30. Hence, as clearly shown in FIG. 7, when the clamp member 40 is oriented with the inner surface 410 adjacent the clamp side 36 of the mount member 30, the upper flange 43 overlies the upper bevel 37 of the mount member 30 and the lower flange 44 extends into the bottom opening 34 of the mount member 30 beneath the roof 343. In this orientation, the lower flange 44 creates a recess together with the roof 343 of the mount member 30 which mirrors somewhat the orientation of the upper and lower slopes 341, 342 of the notch 340 in the side wall 35 of the mount member 30 opposite the clamp member 40.

Each of the two screws 51 is screwed into the respective through hole 38 defined in the mount member 30 and the respective screw hole 22 defined in the slider 20 which is already received in the channel 13 of the housing 10, thereby assembling the housing 10, the slider 20 and the mount member 30 together.

Figure 7:
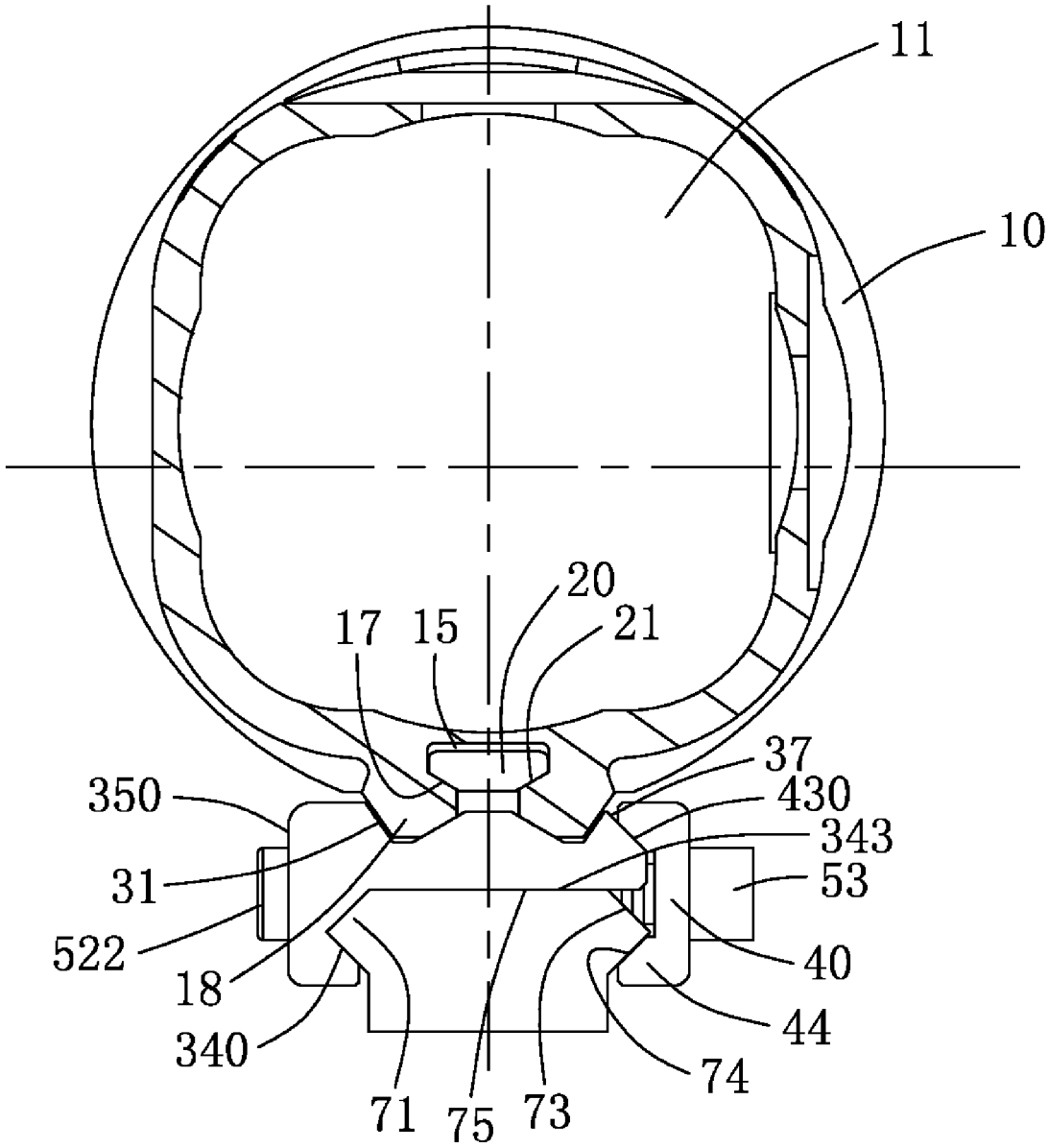
FIG. 7 is an assembled view of FIG. 6.

The bolt 52 is set to extend into the mount member 30 from a left side of the mount member 30 and supports the clamp member 40 and the nut 53 thereon. When the mount member 30 is oriented overlying the upper attachment surface 75 of the mount base 70, the clamp member 40 can be positioned tightly against the mount base 70 by tightening the nut 53, causing the mount member 30 to rigidly connect to the mount base 70. The bolt 52 includes a shaft 520 and a threaded end 521 and a head 522 on opposite ends of the shaft 520. The bolt 52 has a length greater than that of the mount member 30 and a diameter substantially identical to that of the bore 39 in the mount member 30. Hence, the bolt 52 can be put through the bore 39 in the mount member 30 from the left side, until the head 522 abuts against an outer side surface 350 of the side wall 35 of the mount member 30, as shown in FIG. 7. In this position, the threaded end 521 of the bolt 52 extends out beyond the clamp side 36 of the mount member 30 for engagement with the clamp member 40 and the nut 53.

The nut 53 functions to control the position of the clamp member 40 adjacent the clamp side 36 of the mount member 30. The nut 53 defines a screw hole 530 therethrough which forms internal threads on an interior thereof to complementally engage external threads formed on the threaded end 521 of the bolt 52. Hence, when the clamp member 40 is oriented adjacent the clamp side 36 of the mount member 30 with the hole 42 in the clamp member 40 overlying the bolt 52, the nut 70 can be put into engagement with the threads of the bolt 52 and hold the clamp member 40 in place adjacent the clamp side 36 of the mount member 30.

In this configuration, the clamp member 40 together with the coupled mount member 30 can coact with the side ribs 71 of the mount base 70 to securely connect the scope mount 1 to the mount base 70 of the rifle 7. When the scope mount 1 is to be removed from the mount base 70, the nut 53 is rotated to loosen the clamp member 40 from the clamp side 36 of the mount member 30, allowing the side ribs 71 of the mount base 70 to be released. The clamp member 40 and the nut 53 thus provide one form of a means to selectively attach and detach the mount member 30 to the upper attachment surface 75 of the mount base 70. It is noted that other forms of attaching and detaching means could also be adopted.

With the configuration of the universal scope mount 1 in accordance with the present invention, the scope 6 can be securely attached to the mount base 70 on the rifle 7 to assure accurate targeting alignment. By engagement of the slider 20 with the bottom channel 13 defined in the housing 10 and by engagement of the projections 18 of the housing 10 with the corresponding grooves 31 defined in the mount member 30, both lateral and vertical movements of the universal scope mount 1 perpendicular to a long axis of the mount base 70 are prevented. Preferably, the channel 13 of the housing 10 and the corresponding slider 20, and the projections 18 of the housing 10 and the corresponding grooves 31 of the mount member 30, are all configured to have slanted sides at predetermined angles for enhancing engagement therebetween. It is noted that other angles could be equally selected for these slanted sides, provided corresponding mating sides are parallel to each other. Further, longitudinal movement of the universal scope mount 1 along the long axis of the mount base 70 is prevented by the shaft 520 of the bolt 52 fit into and received in the bore 39 of the mount member 30 and a corresponding transverse groove 76 defined in the upper attachment surface 75 of the mount base 70. The friction between the clamp member 40 and one of the side ribs 71 of the mount base 70 and the friction between the upper and lower slopes 341, 342 of the mount member 30 and the other side rib 71 of the mount base 70 further prevent movement of the scope mount 1 off the mount base 70. Therefore, the scope 6 can be securely attached to the mount base 70 on the rifle 7 by the universal scope mount 1 of the present invention. Accurate targeting alignment of the scope 6 on the rifle 7 is also assured, since the housing 10 of the universal scope mount 1 is fixed to the mount base 70 in a parallel manner, as shown in FIG. 10. The mount base 70 is also attached to the rifle 7 with a long axis thereof precisely parallel to a barrel 77 of the rifle 7.

The configuration of the universal scope mount 1 of the present invention increases the mount versatility to a wider variety of applications. The housing 10 of the universal scope mount 1 is configured to define a chamber 11 having an inner contour conforming to an outer contour of the body 60 of a scope 6 to be received. When a user is desired to replace an original scope 6 mounted on the rifle 7 with another scope 6 having different outer diameters or outer contours, the user only needs to replace the original housing 10 with a new one, without the need to purchase a separate scope mount for each individual scope. Accordingly, the universal scope mount 1 of the present invention is applicable to various scopes including those having complex or irregular body contours. Hence, nearly any scope or other accessory that is connectable to the mount base 70 of the rifle 7 can be universally fit to the rifle 7 by the universal scope mount 1 of the present invention.

In addition, the universal scope mount 1 is relatively simple in configuration, which facilitates manufacture and thus reduces cost. The universal scope mount 1 is preferably made of a lightweight material. While a number of possible materials are suitable for the universal scope mount 1, a preferred material is extruded aluminum, whereby manufacture is further facilitated and both the cost and weight of the universal scope mount 1 are reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A universal scope mount for a firearm having a mount base affixed thereon for mounting scopes and other accessories thereto, the mount base of the firearm having an upper attachment surface to which the scopes and other accessories can be connected, the universal scope mount comprising:

a housing having a chamber defined through front and rear ends thereof, a channel downwardly exposed and extending parallel to the chamber and a pair of projections formed along respective opposite sides of the channel, the chamber having an inner contour conforming to an outer contour of a body of a scope or an accessory to be received therein, and the housing further defining an opening at the top for extension of an elevation knob of the scope therethrough; and a pair of mounting assemblies to respectively secure a front end portion and a rear end portion of the housing to the mount base of the firearm, each mounting assembly comprising:

a slider to be slidably received in the channel of the housing and supported by the projections of the housing, the slider having a cross-sectional contour substantially complementary to a cross-sectional contour of the channel of the housing;

a mount member disposed between the housing and the mount base of the firearm, the mount member having an upper mating surface defining two grooves to receive corresponding projections of the housing therein and a bottom opening having a cross-sectional contour substantially complementary to a cross-sectional contour of the mount base of the firearm;

securing means to securely connect the mount member to the upper attachment surface of the mount base of the firearm; and fastening means to reliably assemble the housing, the slider and the mount member together.

2. The universal scope mount as claimed in claim 1, wherein the channel of the housing has a substantial T-shape in cross section and is comprised of an upper horizontal portion and a lower vertical portion.

3. The universal scope mount as claimed in claim 2, wherein said slider is received in the upper horizontal portion of the channel.

4. The universal scope mount as claimed in claim 3, wherein the upper horizontal portion of the channel has opposed side slopes at a lower end thereof proximate to the lower vertical portion, and said slider has opposite side slopes to abut against corresponding side slopes of the channel.

5. The universal scope mount as claimed in claim 4, wherein the side slopes of both the channel and said slider slant toward each other at an approximately 45-degree angle.

6. The universal scope mount as claimed in claim 1, wherein each projection of the housing has opposite side bevels at a free end thereof, and each groove of said mount member has opposite side slants to abut against the side bevels of a corresponding projection of the housing.

7. The universal scope mount as claimed in claim 1, wherein said mount member defines two through holes through the upper mating surface, and said slider defines two screw holes spaced at a distance substantially equal to that between the two through holes of said mount member.

8. The universal scope mount as claimed in claim 7, wherein the two through holes of said mount member are defined through a mount tooth formed between the two grooves.

9. The universal scope mount as claimed in claim 7, wherein the fastening means includes two screws to be respectively screwed into said two through holes of said mount member and said two screw holes of said slider.

10. The universal scope mount as claimed in claim 1, wherein the bottom opening of said mount member includes a roof having a width substantially equal to a width of the upper attachment surface of the mount base of the firearm.

11. The universal scope mount as claimed in claim 1, wherein the securing means includes a clamp member having an inner surface at least partially facing the cross-sectional contour of the bottom opening of said mount member, and an adjusting means to adjust the location of said clamp member toward and away from the cross-sectional contour of the bottom opening of said mount member, such that said clamp member can be caused to securely capture the mount base of the rifle between said clamp member and the cross-sectional contour of the bottom opening of said mount member.

12. The universal scope mount as claimed in claim 11, wherein the adjusting means includes a bolt to be extended through said mount member and said clamp member and a nut provided adjacent to said clamp member to be treaded onto a free end of the bolt.

13. The universal scope mount as claimed in claim 12, wherein said mount member has a side wall, a clamp side opposite to the side wall for connection with said clamp member and a bore defined therethrough in a direction perpendicular to the grooves for receiving the bolt, the bore including a base end in the side wall and a clamp end extending through the clamp side in communication with the bottom opening, and wherein said clamp member defines a hole therethrough to align with the bore of said mount member and thus receive the free end of the bolt.

14. The universal scope mount as claimed in claim 13, wherein the clamp end of the bore of said mount member is semi-circular in cross section to cooperate with a corresponding transverse groove in the upper attachment surface of the mount base of the firearm to form a circular hole for extension of the bolt.

15. The universal scope mount as claimed in claim 11, wherein said mount member has a side wall and a clamp side opposite to the side wall for connection with said clamp member, and wherein the bottom opening of said mount member includes a notch defined in the side wall to complementally receive a side rib of the mount base of the firearm.

16. The universal scope mount as claimed in claim 15, wherein the inner surface of said clamp member has a height greater than a height of the clamp side of said mount member.

17. The universal scope mount as claimed in claim 16, wherein said clamp member has upper and lower flanges extending from respective opposite ends thereof in a common direction toward said mount member, the lower flange having an inner slanted surface extending at an angle matching that of a lower slope of a side rib of the mount base of the firearm opposite to the side rib received in the notch of said mount member.

18. The universal scope mount as claimed in claim 17, wherein said mount member further comprises an upper bevel oriented between one groove and the clamp side, and the upper flange of said clamp member has an inner slanted surface extending at an angle matching that of the upper bevel of said mount member.

19. The universal scope mount as claimed in claim 1, wherein the universal scope mount is made of extruded aluminum.

* * * * *